US008490451B2

(12) United States Patent
Denker

(10) Patent No.: US 8,490,451 B2
(45) Date of Patent: Jul. 23, 2013

(54) METHOD FOR ROLLING STRIP-SHAPED ROLLING STOCK, IN PARTICULAR METAL STRIP

(75) Inventor: Wolfgang Denker, Freudenberg (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/519,055

(22) PCT Filed: Dec. 10, 2010

(86) PCT No.: PCT/EP2010/069422

§ 371 (c)(1),
(2), (4) Date: Jul. 17, 2012

(87) PCT Pub. No.: WO2011/076592

PCT Pub. Date: Jun. 30, 2011

(65) Prior Publication Data

US 2012/0272703 A1 Nov. 1, 2012

(30) Foreign Application Priority Data

Dec. 23, 2009 (DE) ..... 10 2009 060 259

(51) Int. Cl.
*B21B 1/32* (2006.01)

(52) U.S. Cl.
USPC ..... 72/229; 72/203

(58) Field of Classification Search
USPC ..... 72/146, 203, 205, 206, 221, 227, 72/229, 365.2, 366.2; 29/33 Q
See application file for complete search history.

(56) References Cited

U.S. PATENT DOCUMENTS

| | | | | |
|---|---|---|---|---|
| 4,086,689 | A * | 5/1978 | Martt | 29/33 B |
| 6,216,516 | B1 | 4/2001 | Klamma et al. | |
| 6,604,398 | B1 | 8/2003 | Hansen | |
| 7,398,666 | B2 | 7/2008 | Denker | |

FOREIGN PATENT DOCUMENTS

| | | | |
|---|---|---|---|
| DE | 19905286 | A | 8/2000 |
| EP | 0724919A2 | A | 8/1996 |
| EP | 0724919 | B1 | 8/2001 |
| EP | 1148956 | B1 | 6/2003 |
| EP | 1701808 | B1 | 10/2007 |
| JP | 55064906 | A | 5/1980 |
| WO | 2005056206 | A | 6/2005 |

* cited by examiner

*Primary Examiner* — Debra Sullivan
(74) *Attorney, Agent, or Firm* — Lucas & Mercanti, LLP; Klaus P. Stoffel

(57) ABSTRACT

The invention relates to a method for rolling strip-shaped rolling stock, in particular metal strip. This method is characterized substantially by the following procedure: the metal strip A exiting the pickling line passes through the two roll stands (3, 4) of the reversing roll stand, wherein the start of a subsequent metal strip B has already been welded to the strip end of the metal strip A before entering the pickling line (5), said start of the metal strip B is then rolled as well, specifically over a length corresponding to the wind-on length until tension is built up on the reel and likewise rims on the reversing reel (1), during the subsequent reversing the metal strip B is separated from the metal strip A such that the already rolled start of the metal strip B remains on the still unrolled remaining metal strip B, then the complete metal strip A is reverse-rolled.

3 Claims, 6 Drawing Sheets

METHOD FOR ROLLING STRIP-SHAPED ROLLING STOCK, IN PARTICULAR METAL STRIP

The present application is a 371 of International application PCT/EP2010/069422, filed Dec. 10, 2010, which claims priority of DE 10 2009 060 259.3, filed Dec. 23, 2009, the priority of these applications is hereby claimed and these applications are incorporated herein by reference.

BACKGROUND OF THE INVENTION

The invention relates to a method of rolling strip-shaped rolling stock, particularly metal strip, wherein the metal strip initially travels through a pickling line and then between two reversing reels through a reversing rolling mill, and wherein the end of a metal strip is welded to the beginning of the next following metal strip before the pickling line and, prior to reeling the finished rolled metal strip, a separation of the metal strips welded to each other takes place.

Metal strip, pickling plants and rolling mills are available as individual plants which are standing on their own, or as coupled plants.

Coupled plants are generally equipped with at least three roll stands, so that the maximum decrease of the rolling stock is limited. In this connection the investment costs are very high and will be economical only with high production quantities.

In order to realize the decrease of rolled strip to finished thickness the coils are, in the case of individual stands, rolled several times in a reversing operation.

In continuous rolling trains the strip beginning of the next coil is welded to the end of the strip and, thus, threading in of the respectively next coil is unnecessary.

Individual pickling lines usually have one or two reels with coil carriage and coil receiving locations, as well as reversing plants and an uncoiling station with coil carriage and coil receiving locations.

A method and a plant for rolling strip-shaped rolling stock is known from EP 170 1808 B1, with a reversing rolling mill and with reels arranged in front and after for coiling the metal strip and an upstream pickling line and a welding machine arranged in front of the pickling line, for welding strip end and strip beginning together.

SUMMARY OF THE INVENTION

It is the object of the invention to make the method for rolling strip-shaped rolling stock, particularly metal strip, more economical.

In accordance with the invention, this object is met with a method for rolling strip-shaped rolling stock, particularly metal strip, wherein the metal strip initially travels through a pickling line and then between two reversing wheels through a reversing rolling mill, and wherein the end of a metal strip is welded to the beginning of a subsequent metal strip before the pickling line and, prior to reeling the finished rolled metal strip, a separation of the welded together metal strips takes place in the following sequence:

The metal strip A emerging from the pickling line travels through the two roll stands of the reversing roll stand and is then reeled onto the reversing reel arranged downstream of the reversing rolling mill;

wherein, prior to entering the pickling line, the beginning of a next following metal strip B has already been welded onto the end of the metal strip A;

this strip beginning of metal strip B is now rolled together with strip A over a length which corresponds to the initial winding length up to the tension-buildup and travels also on the reversing reel;

during subsequent reversing, the metal strip B is separated from the metal strip A by means of shears, so that the already rolled strip beginning of the metal strip B remains at the remaining metal strip B which has not yet been rolled;

subsequently, reversing rolling of the complete metal strip A takes place, wherein, after emerging from the reversing rolling mill, the metal strip A runs onto the reversing reel arranged upstream of the reversing stand;

as soon as the metal strip A is completely on the reversing reel 2, the metal strip B is fed to the reversing rolling mill and the above sequences are repeated with this metal strip B and any subsequent metal strip C.

Accordingly, the invention is based on the basic concept of connecting the strip ends of coils and a reversing roll stand, usually composed of several roll stands arranged one behind the other, and to feed the strip end to a reversing roll stand through a strip storage as material storage for the duration of finish-rolling of the previous coil.

As a result, a coupled, continuous pickling/rolling process is achieved in the first roll pass.

The strip beginning is welded to the end of the previous coil at the end of the first pass over a length which is necessary for covering the initial winding length until tension build-up is reached. This strip beginning is also reversed until the previous coil has been cut in order to feed it back to the reversing reel 2. This strip beginning of the actual coil then remains in the strip storage until the previous coil has finished reversing.

In order to maintain a continuous operation of the pickling unit, the strip storage is made large in order to bridge the time until the previous coil has been finish-rolled. The pickling unit, in turn, is configured with respect to its process speed such that the production quantity is equal to the maximum production quantity of the reversing plant.

The advantages are shortest coiled sequence times, and fewer dis-connection lengths because the strip beginning is already reduced in its thickness as a result of two rolling passes.

Another advantage is that the coil storage is omitted and the coil transport devices are in the run-out part of the pickling unit and the coil preparation of the reversing unit. Consequently, there is no damage to the coil caused by transportation.

In the following the method sequence shall be explained with reference to the drawings.

DETAILED DESCRIPTION OF THE INVENTION

Figure 1:
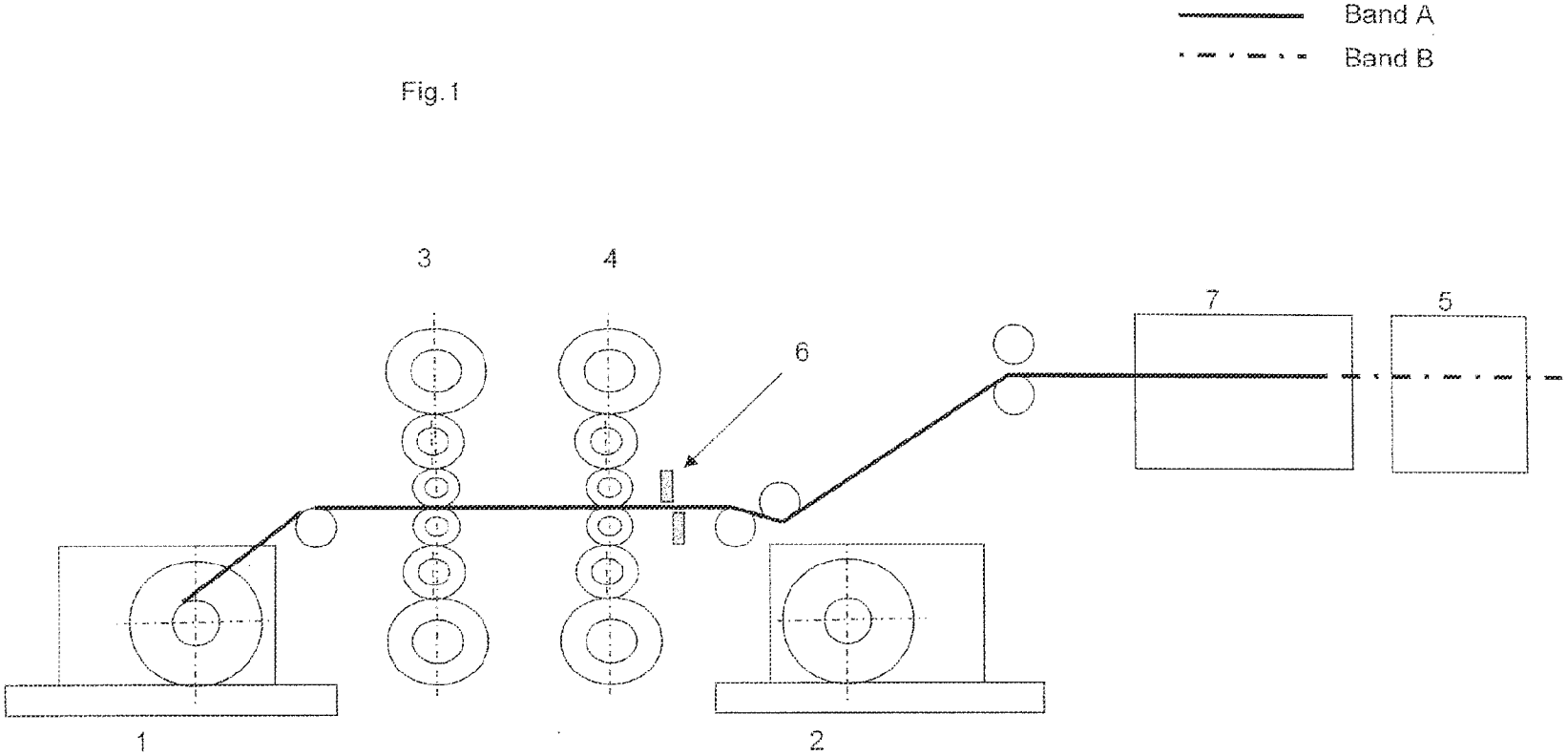
FIGS. 1-6 show schematic representations of the inventive method.

The strip A emerging from the pickling unit travels through the two roll stands 3, 4 and is then reeled on the reversing reel 1 (FIG. 1).

The beginning of a strip B is already welded to the strip end of strip A prior to entering the pickling unit 5. This strip beginning of strip B is now rolled together with strip A over a length which corresponds to the initial winding length until tension-buildup of the reel is reached.

Figure 2:
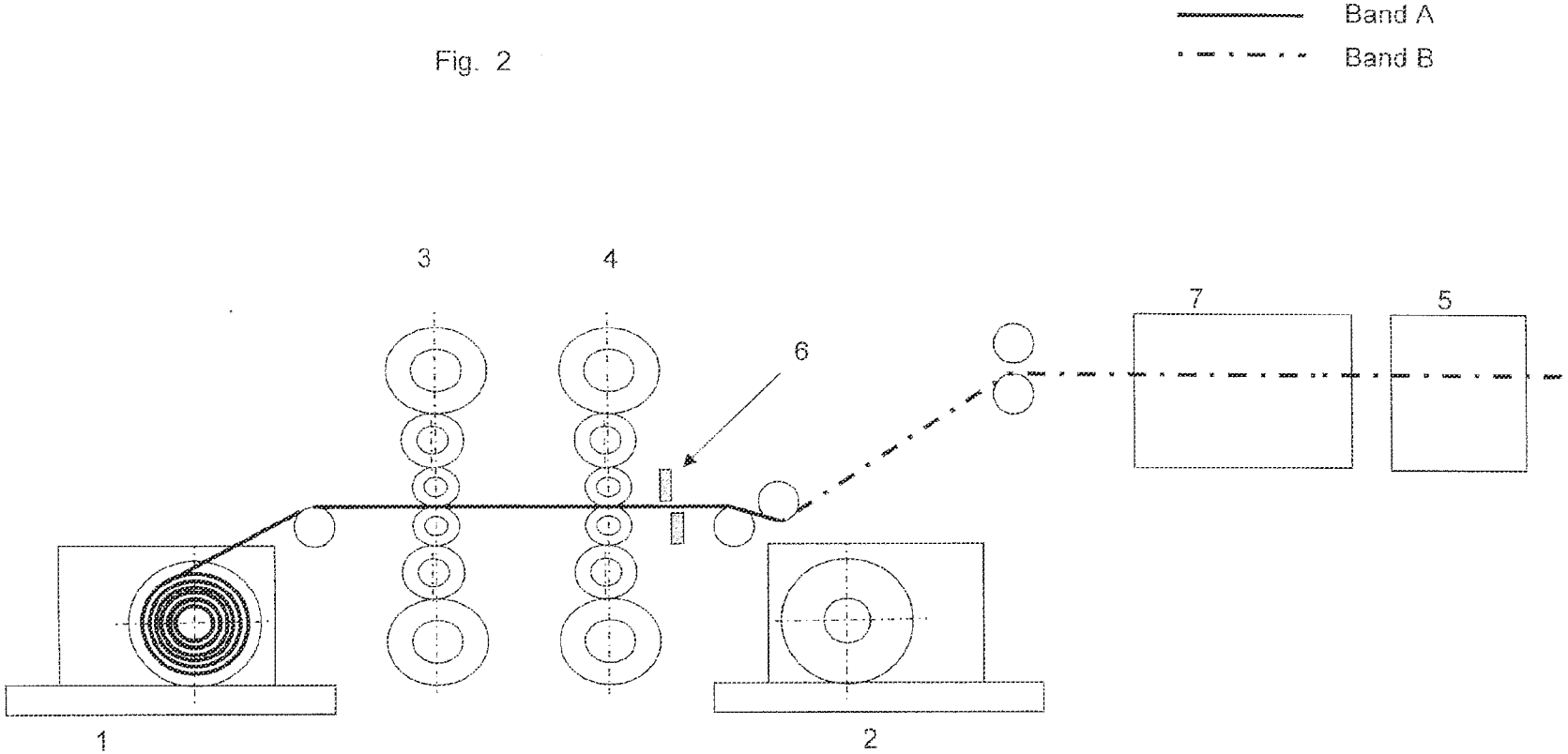
Figure 3:
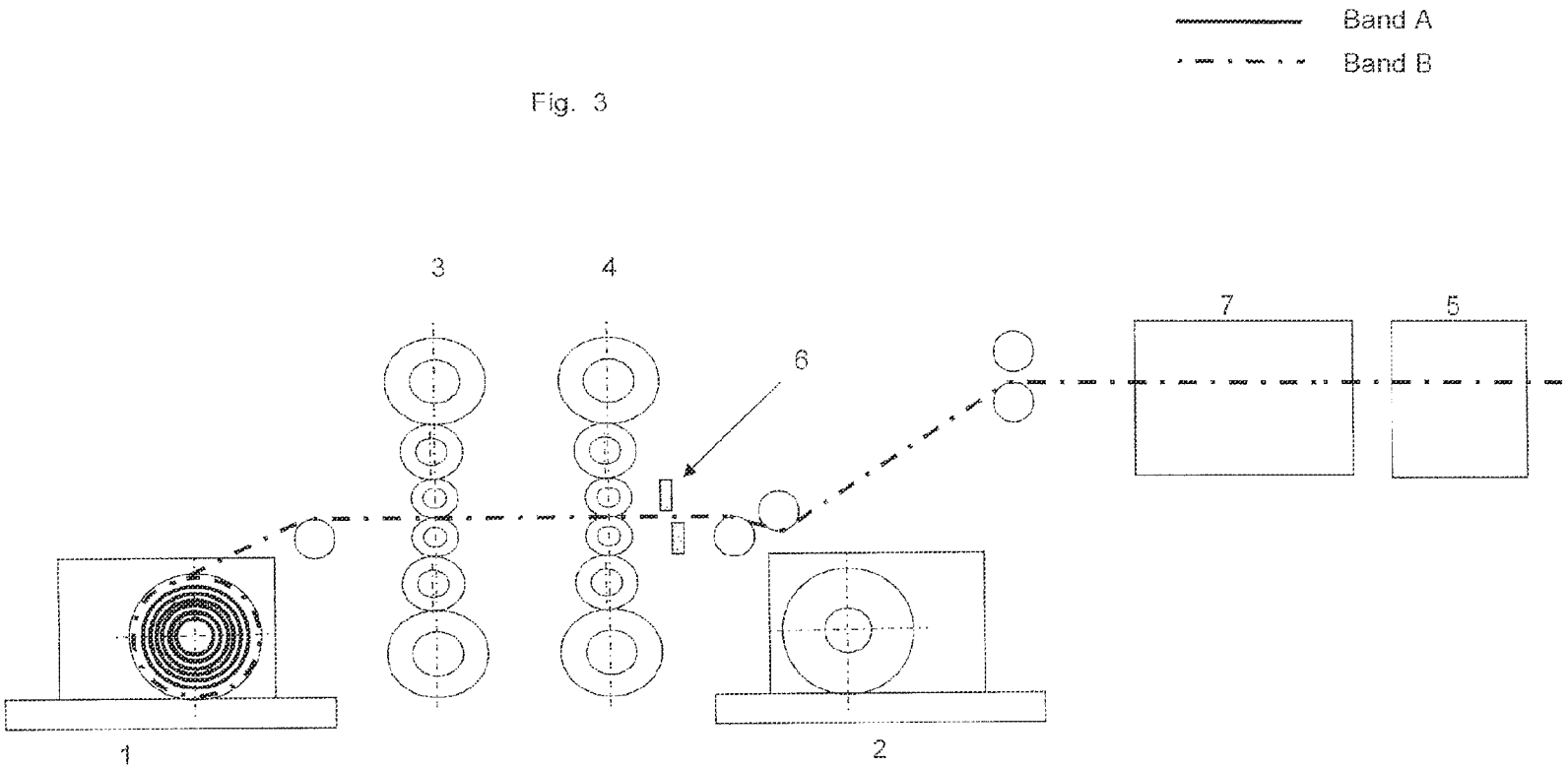

FIG. 2 shows the strip B in dot-dash lines. It can be seen in this FIG. 2 and the additional FIG. 3 that the strip beginning of the strip B runs up against the reversing reel 1 together with the strip A.

Figure 4:
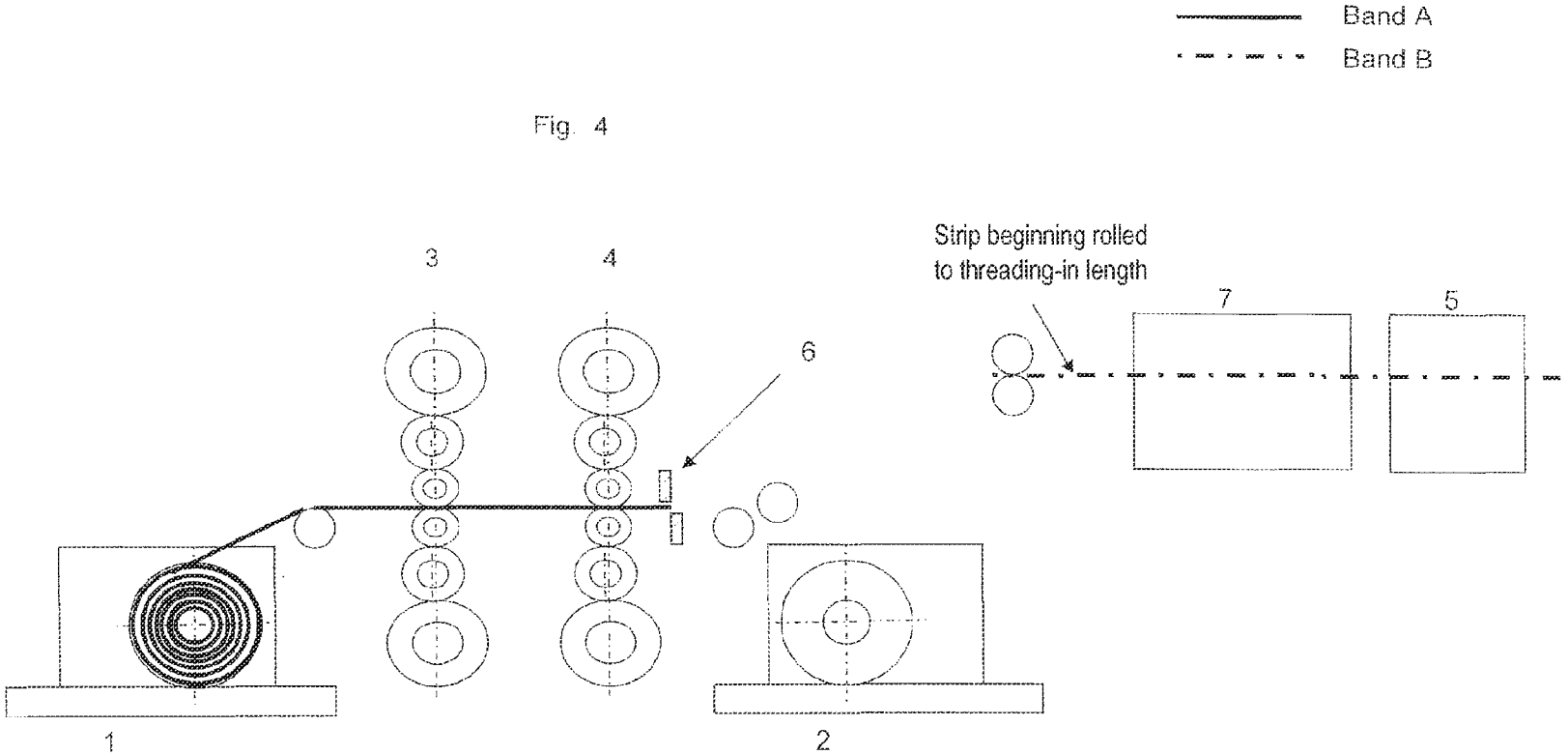

During subsequent reversing rolling, the strip B is severed from the strip A by the shears 6, so that the already rolled strip beginning of the strip B, remains with the remaining strip B, which has not yet been rolled (FIG. 4).

Figure 5:
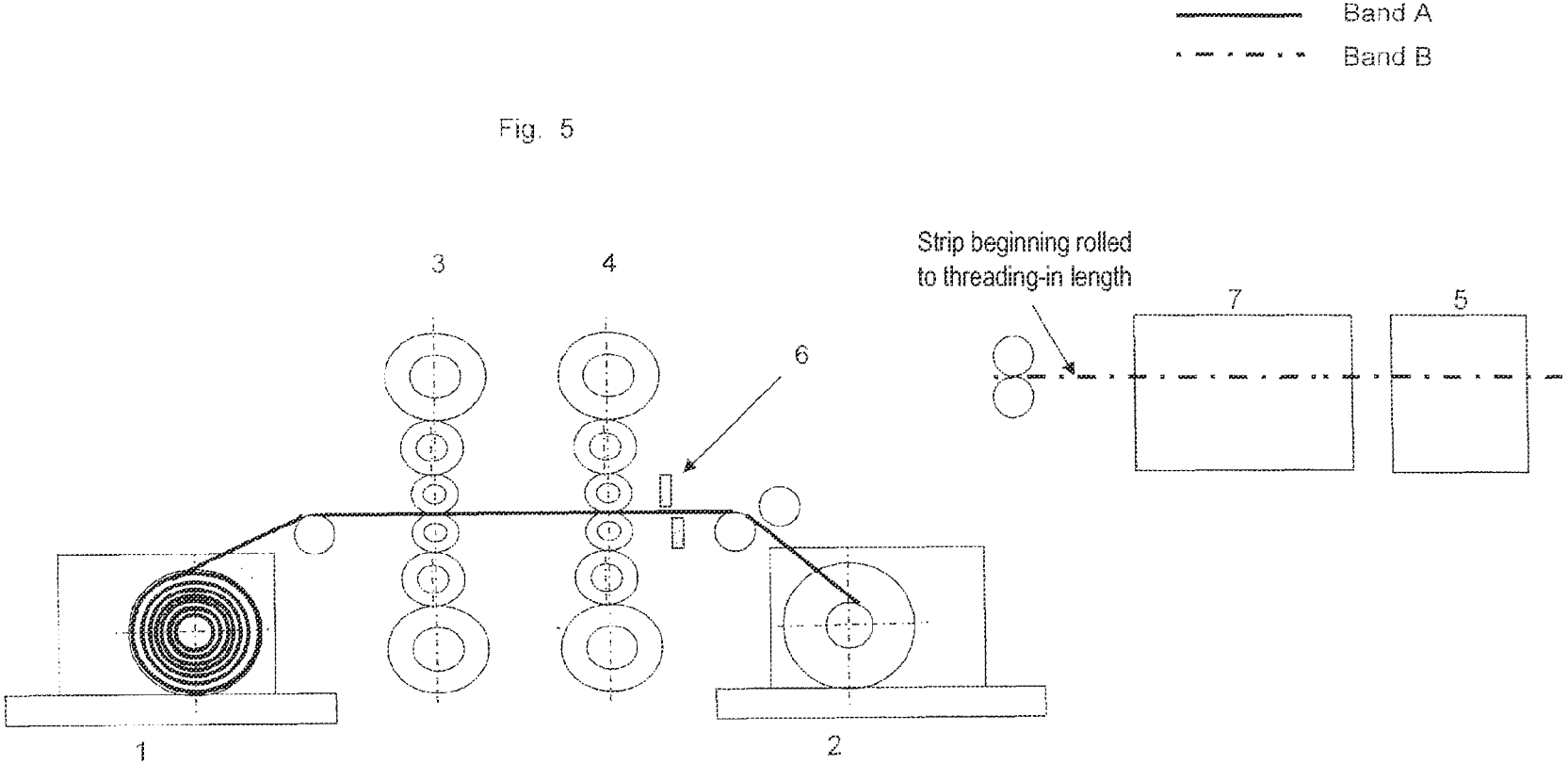

Subsequently, the complete reversing of the strip A with a coiler on the reversing reel 2, takes place (FIG. 5).

Figure 6:
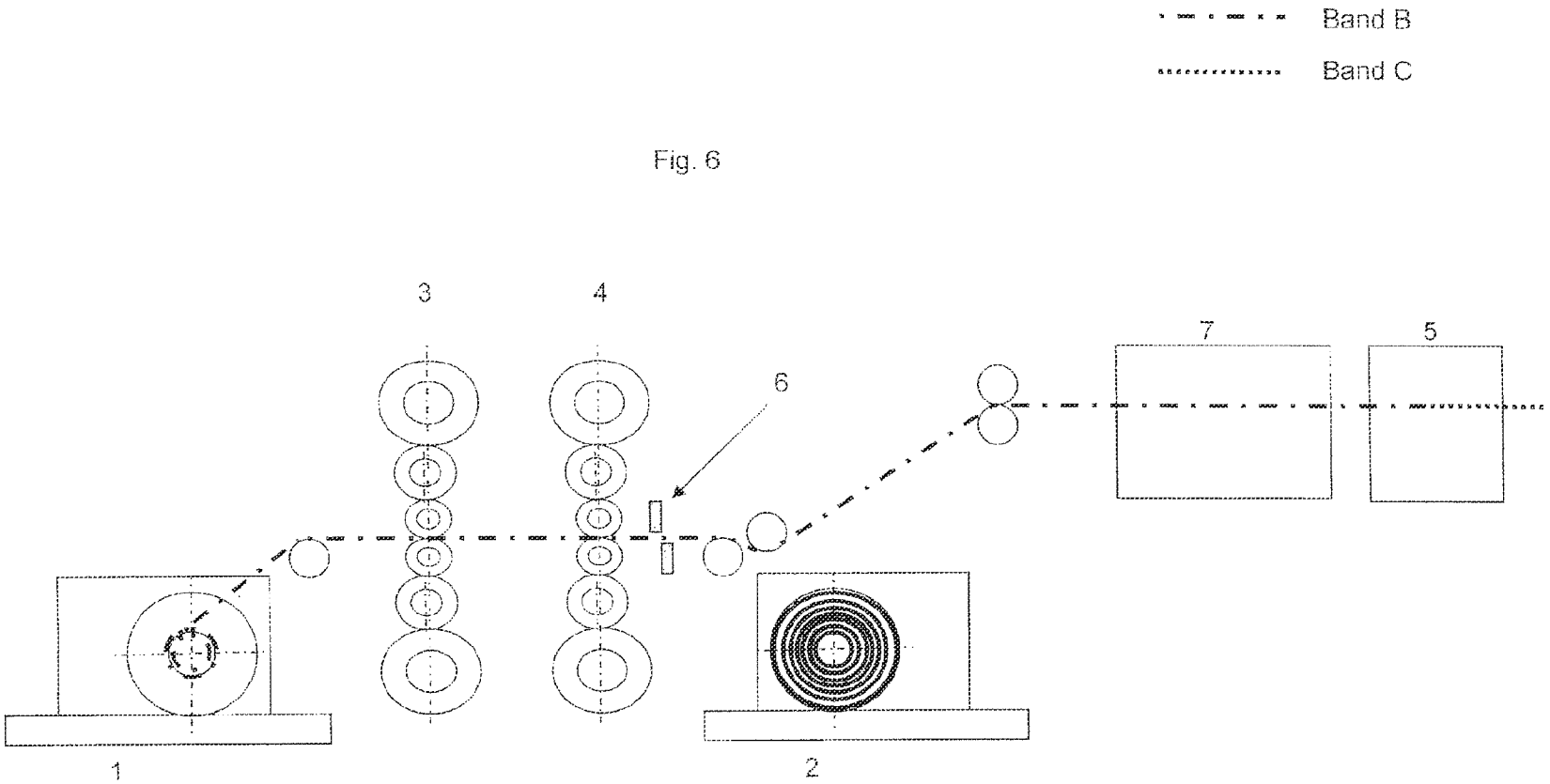

The next FIG. 6 once again shows the beginning of a new pickling/rolling sequence with the strips B and C.

To the end of the strip B once again the beginning of a strip C was welded, so that the pickling/rolling process can take place continuously for these two strips.

When threading in the already rolled strip beginning of the strip B, or later of C, the roll gap may remain open, so that the rolls become active only upon entry of the strip portion which has not yet been rolled and which follows the rolled strip beginning.

During the reversing rolling of one metal strip between the pickling line and the shears for severing the metal strips, storage of the subsequent metal strip in strip storage unit 7 can take place.

The invention claimed is:

1. Method of rolling metal strip, wherein the metal strip initially travels through a pickling line and then between two reversing reels, through a reversing rolling mill, and wherein the end of a metal strip is welded to the beginning of a next following metal strip before the pickling line, and wherein prior to reeling the finished rolled metal strip, a separation of the welded together metal strips takes place, comprising the following sequence:

the metal strip A emerging from the pickling line travels through two roll stands (3, 4) of the reversing rolling mill and is then reeled onto the reversing reel (1) arranged following the reversing rolling mill;

wherein, prior to entering the pickling line (5), the beginning of the next following metal strip B has already been welded onto the end of the metal strip A;

this strip beginning of metal strip B is now rolled together with strip A over a length which corresponds to an initial winding length up to a tension-buildup and also travels onto the reversing reel (1);

during subsequent reversing, the metal strip B is separated from the metal strip A by shears (6) such that the already rolled strip beginning of the metal strip B remains with the remaining metal strip B which has not yet been rolled;

subsequently the reversing rolling of the complete metal strip A takes place, wherein after emerging from the reversing rolling mill, the metal strip A runs onto the reversing reel arranged upstream of the reversing stand;

as soon as the metal strip A is completely on the reversing reel (2), the metal strip B is fed to the reversing rolling mill and the above sequence is repeated with this metal strip B and a subsequent metal strip C.

2. Method according to claim 1, wherein when threading in the already rolled strip beginning of the metal strip B, or later of C, a roll gap of the reversing rolling mill remains open so that the rolls become active only upon entry of the non-rolled strip portion following the roll strip beginning.

3. Method according to claim 1, wherein during the reversing rolling of one metal strip, between the pickling line and shears for separating the metal strips, a storage of the subsequent metal strip in a strip storage unit takes place.

* * * * *